US005569028A

United States Patent [19]

Yamamura et al.

[11] Patent Number: 5,569,028

[45] Date of Patent: Oct. 29, 1996

[54] SCROLL COMPRESSOR HAVING A COMPRESSOR HOUSING MADE UP OF A CUP-LIKE FRONT CASING AND A CAP-LIKE REAR CASING

[75] Inventors: Michio Yamamura, Kusatsu; Kunio Iwanami, Moriyama; Tatsuhisa Taguchi, Katano; Masafumi Fukushima, Kusatsu, all of Japan

[73] Assignee: Matsushita Electric Industrial Co., Ltd., Osaka-fu, Japan

[21] Appl. No.: 500,370

[22] Filed: Jul. 10, 1995

[30] Foreign Application Priority Data

Nov. 30, 1994 [JP] Japan ..... 6-296587

[51] Int. Cl.[6] ..... F01C 1/04

[52] U.S. Cl. ..... 418/55.3; 418/55.1; 418/55.4; 418/88; 418/96; 418/98; 464/104

[58] Field of Search ..... 418/55.1, 55.3, 418/55.4, 69, 88, 96, 98, 149; 464/104; 184/6.16

[56] References Cited

U.S. PATENT DOCUMENTS

| | | | |
|---|---|---|---|
| 4,411,604 | 10/1983 | Terauchi | 418/55 |
| 4,818,198 | 4/1989 | Tamura | 418/96 |
| 4,861,245 | 8/1989 | Tojo et al. | 418/55.3 |
| 4,917,582 | 4/1990 | Fraser, Jr. et al. | 418/88 |

FOREIGN PATENT DOCUMENTS

| | | | |
|---|---|---|---|
| 85387 | 5/1983 | Japan | 418/55.3 |
| 117187 | 5/1988 | Japan | 418/55.3 |

*Primary Examiner*—Charles G. Freay

*Attorney, Agent, or Firm*—Wenderoth, Lind & Ponack

[57] ABSTRACT

A scroll compressor includes a compressor housing made up of a cup-like first casing having a suction port defined therein and a cap-like second casing having a discharge port defined therein. The compressor housing accommodates a stationary scroll member having a stationary end plate and a stationary scroll wrap protruding axially from the stationary end plate, and an orbiting scroll member having an orbiting end plate and an orbiting scroll wrap protruding axially from the orbiting end plate, with the orbiting scroll wrap being in engagement with the stationary scroll wrap to define a plurality of working pockets therebetween. At least one shim is interposed between mating surfaces of the first and second casings to regulate axial gaps between axial end surfaces of the stationary and orbiting scroll wraps and the orbiting and stationary end plates opposed thereto. The stationary end plate is positioned in the proximity of the mating surfaces of the first and second casings so that a low-pressure chamber is defined between the stationary end plate and the first casing, while a high-pressure chamber is defined between the stationary end plate and the second casing. The location of the stationary end plate in the proximity of the mating surfaces of the first and second casings reduces a variation in the axial gaps referred to above.

5 Claims, 10 Drawing Sheets

SCROLL COMPRESSOR HAVING A COMPRESSOR HOUSING MADE UP OF A CUP-LIKE FRONT CASING AND A CAP-LIKE REAR CASING

BACKGROUND OF THE INVENTION

1. Field of the Invention

The present invention relates to a scroll compressor suited for use in, for example, an air conditioner, a refrigerator or the like.

2. Description of Related Art

The scroll compressor and its operating principle are disclosed in numerous patent and technical literature and are, therefore, well known to those skilled in the art. As an example of the scroll compressor, U.S. Pat. No. 4,492,543 (corresponding to Japanese Patent Publication No. 61-15276) or U.S. Pat. No. 4,411,604 (corresponding to Japanese Patent Publication No. 58-55359) discloses an open scroll compressor for use in an automotive air conditioner, as shown in FIGS. 8 and 9. The scroll compressor disclosed in U.S. Pat. No. 4,492,543 employs a ball joint assembly which serves both as a thrust support for supporting a thrust force applied to an orbiting end plate of an orbiting scroll member and a rotation constraint element for preventing rotation of the orbiting scroll member about its own axis while permitting it to undergo an orbiting motion relative to a stationary scroll member. On the other hand, the scroll compressor disclosed in U.S. Pat. No. 4,411,604 includes a compressor housing made up of a cup-like casing and a front end plate secured to each other. In FIGS. 8 and 9, the construction for transmitting a drive force from an engine to a compressor body through a belt and an electromagnetic clutch is omitted, because it is well known to those skilled in the art.

The scroll compressor shown in FIGS. 8 and 9 comprises a generally cylindrical compressor housing 3 made up of a cup-like casing 37 and a front end plate 38 with an open end of the cup-like casing 37 closed by the front end plate 38. A stationary scroll member 1, including a stationary end plate 1*a* and a stationary scroll wrap 1*b* protruding axially from one end surface of the stationary end plate 1*a*, and an orbiting scroll member 2 similarly including an orbiting end plate 2*a* and an orbiting scroll wrap 2*b* protruding axially from one end surface of the orbiting end plate 2*a* are operatively accommodated within the compressor housing 3 with the stationary and orbiting scroll wraps 1*b* and 2*b* engaging with each other to define a plurality of volume-variable, sealed working pockets 10 therebetween. A ring-shaped first race 71, a first ring 72, a plurality of ball elements 76, a second ring 74, and a ring-shaped second race 73, all of which serve both as thrust support elements and rotation constraint elements, are disposed in this order between the orbiting end plate 2*a* and the front end plate 38. All of the ring-shaped first race 71, first ring 72, second ring 74, and ring-shaped second race 73 have a generally flat configuration and extend in parallel to the orbiting end plate 2*a*. A drive mechanism for imparting an orbiting motion to the orbiting scroll member 2 is disposed between the ring-shaped second race 73 and the front end plate 38. The stationary scroll member 1 has a plurality of fastening legs 1*d* formed on the rear surface of the stationary end plate 1*a* with the fastening legs 1*d* fastened to the cup-like casing 37 by means of bolts 19. The stationary end plate 1*a* of the stationary scroll member 1 has a seal groove 1*f* defined therein along a peripheral portion 1*e* thereof, in which an O-ring 18 is received to seal between a high-pressure chamber 11 and a low-pressure chamber 12 both defined within the compressor housing 3 and partitioned by the stationary end plate 1*a*. The first ring 72 is mounted on the orbiting end plate 2*a* so as to cover the ring-shaped first race 71, while the second ring 74 is mounted on the front end plate 38 so as to cover the ring-shaped second race 73 with a relatively narrow gap defined between the first and second rings 72 and 74. Each of the first and second rings 72 and 74 has a plurality of regularly spaced holes 75 of an identical size defined therein, and the holes 75 in the first ring 72 are axially aligned with those 75 in the second ring 74. The plurality of ball elements 76 referred to above are interposed between the first and second rings 72 and 74, and are received in both the holes 75 of the first ring 72 and those 75 of the second ring 74, thereby preventing rotation of the orbiting scroll member 2 about its own axis while permitting it to undergo an orbiting motion relative the stationary scroll member 1. A drive shaft 9 is rotatably supported by a main bearing 15 securely mounted in the compressor housing 3 and has a main shaft portion 9*a* extending through a sealing assembly 17 and an auxiliary bearing 16 so as to protrude outwardly from the compressor housing 3. The drive shaft 9 has a rear end integrally formed with an eccentric drive pin 9*b* having its longitudinal axis parallel to, but offset a predetermined distance laterally from the longitudinal axis of the drive shaft 9. The eccentric drive pin 9*b* is received in an orbiting bush 8 employed as one of the drive mechanism. The orbiting bush 8 is inserted into an orbiting bearing 7, which is in turn inserted rotatably into a cylindrical boss 2*c* integral with the orbiting end plate 2*a* of the orbiting scroll member 2, to thereby complete an orbiting mechanism required for orbiting the orbiting scroll member 2 relative to the stationary scroll member 1. The cup-like casing 37 has a suction port 13 defined therein on the side of the low-pressure chamber 12 to introduce refrigerant employed as a working fluid therein and, also, has a discharge port 14 defined therein on the side of the high-pressure chamber 11 to discharge the refrigerant therefrom.

When a compression stroke is started by the orbiting motion of the orbiting scroll member 2 relative to the stationary scroll member 1, the refrigerant is drawn into the low-pressure chamber 12 through the suction port 13. The refrigerant is then introduced into the sealed working pockets 10 delimited by the stationary end plate 1*a*, stationary scroll wrap 1*b*, orbiting end plate 2*a*, and orbiting scroll wrap 2*b*, and is compressed as it moves from peripheral portions of the stationary and orbiting scroll wraps 1*b* and 2*b* towards a central portion. The compressed refrigerant is subsequently discharged into the high-pressure chamber 11 through a center discharge hole 1*c* defined in the stationary end plate 1*a* and flows out from the compressor housing 3 through the discharge port 14.

Japanese Laid-open Patent Publication (unexamined) No. 4-116201 discloses a method of assembling a scroll compressor as shown in, for example, FIGS. 8 and 9. According to this disclosure, when the open end of the cup-like casing 37 is closed by the front end plate 38, one or more shims 20 are sandwiched between mating surfaces of the cup-like casing 37 and the front end plate 38 to regulate an axial gap between the stationary and orbiting end plates 1*a* and 2*a*, thereby maintaining predetermined axial gaps between axial end surfaces of the stationary and orbiting scroll wraps 1*b* and 2*b* and associated orbiting and stationary end plates 2*a* and 1*a* opposed thereto.

Japanese Laid-open Utility Model Publication (unexamined) No. 4-87380 discloses a scroll compressor shown in FIG. 10 and comprising a stationary scroll member 1, an orbiting scroll member 2, an orbiting mechanism, a drive shaft 9, and a drive mechanism, all of which are generally identical in construction to those of the scroll compressor shown in FIGS. 8 and 9. Although a compressor housing 3 shown in FIG. 10 is made up of a cup-like casing 37 and a front end plate 38, like the compressor housing shown in FIGS. 8 and 9, the front end plate 38 is a two-component member made up of an annular front plate 38*a* and a cylindrical member 38*b* rigidly secured to each other, unlike the compressor housing shown in FIGS. 8 and 9. The compressor housing 3 shown in FIG. 10 accommodates a thrust support element in the form of a generally flat thrust bearing 4 and a rotation constraint element in the form of an Oldham ring 5 both interposed between the orbiting end plate 2*a* and the annular front plate 38*a*.

In this construction, the axial gaps between the scroll wraps 1*b* and 2*b* and the associated end plates 2*a* and 1*a* opposed thereto can be regulated by appropriately changing the thickness of the thrust bearing 4, instead of changing that of the shims.

FIG. 11 depicts a method of assembling the scroll compressor. As shown therein, the front end plate 38 is first placed on a mount 48 with its open end directed upwardly and is subsequently coupled with the drive mechanism and the orbiting mechanism. The orbiting scroll member 2 is then incorporated into the front end plate 38 with the orbiting scroll wrap 2*b* directed upwardly. At this moment, the distance A2 between the upper surface of the orbiting end plate 2*a* and the mating surface of the front end plate 38 with the cup-like casing 37 is measured using a measuring instrument 50. Likewise, the distance A1 between the lower end surface of the stationary scroll wrap 1*b* and the mating surface of the cup-like casing 37 with the front end plate 38 is measured using the measuring instrument 50. Then, the cup-like casing 37 is rigidly secured to the front end plate 38 while the axial gaps are being regulated by changing the thickness of the shims 20 or the thrust bearing 4 so that the difference between the two distances A1 and A2 may fall within a permissible tolerance.

The conventional scroll compressors referred to above encounter several disadvantages. By way of example, the ball joint assembly shown in FIGS. 8 and 9 which serves both as a thrust support and a rotation constraint element often causes irregular rolling of the ball elements 76, which in turn generates a relatively large noise. Also, because the thrust force of the orbiting scroll member 2 is supported by the ball elements 76 and the two races 71 and 73 sandwiching the ball elements 76 therebetween, the material thereof is required to be hard and high in rigidity, resulting in an increase in weight. Furthermore, as the speed of the orbiting motion of the orbiting scroll member 2 relative to the stationary scroll member 1 increases, the centrifugal force increases and, hence, each of the main bearing 15 and the orbiting bearing 7 tends to receive an excessively large load. In addition, because the axial gaps vary considerably and are difficult to make constant, the performance and reliability of the compressor is adversely affected thereby. An attempt to reduce the axial gaps or to make them substantially constant results in at least an increase of the kind of shims interposed between the cup-like casing 37 and the front end plate 38. Also, because many element parts including the ball elements 76 and their associated elements are required, it is difficult to maintain the accuracy of such element parts or to accurately assemble the compressor due to irregular rolling of the ball elements, thus hindering an automated assemblage of the compressor.

On the other hand, the conventional scroll compressor shown in FIG. 10 employs a generally flat thrust bearing 4 as a thrust support element and an Oldham ring 5 as a rotation constraint element. Although this construction lowers the noise level compared with the ball joint assembly referred to above, sliding portions of the thrust bearing 4 and those of the Oldham ring 5 are accompanied with sliding friction, and an increase in friction loss results in a decrease in performance. Also, the regulation of the axial gaps between the scroll wraps 1*b* and 2*b* and the associated end plates 2*a* and 1*a* by an appropriate selection of the thickness of the thrust bearing 4 inevitably increases the kind of thrust bearings. In this case, if an inappropriate thrust bearing is erroneously incorporated into the compressor housing, many element parts including the orbiting scroll member and the like already assembled must be disassembled and then reassembled, taking much time and labor. Moreover, the separated structure of the front end plate 38 results in an increase in manufacturing cost.

Each of the compressor housing 3 shown in FIGS. 8 and 9 and that shown in FIG. 10 is made up of at least two separated members i.e., the cup-like casing 37 and the front end plate 38 with both the suction port 13 and the discharge port 14 defined in the cup-like casing 37. In such a compressor housing 3, the mating surfaces of the cup-like casing 37 and the front end plate 38 are positioned frontwardly (right-hand side in FIG. 8 and left-hand side in FIG. 10) of the front surface of the orbiting end plate 2*a* and radially outwardly of the drive shaft 9, while the O-ring 18 received in the seal groove 1*f* of the stationary end plate 1*a* for sealing between the high-pressure chamber 11 and the low-pressure chamber 12 is positioned deep within the cup-like casing 37. Because of this, if the O-ring 18 is incompletely received in the seal groove 1*f* during assemblage, the erroneous mounting of the O-ring 18 cannot be readily noticed. Although this results in a gas leakage from the high-pressure chamber 11 to the low-pressure chamber 12 and, hence, can be discovered during a leakage inspection, it is necessary to remove and again incorporate the stationary scroll member 1 from and into the cup-like casing 37. At this moment, whether threaded portions for fastening the stationary scroll member 1 to the cup-like casing 37 have been damaged or not must be checked and leakage from the threaded portions must be checked, requiring much time and labor.

Furthermore, as discussed above with reference to FIG. 11, in order to obtain the predetermined axial gaps referred to above, measurement of the distance between the open end surface of the cup-like casing 37 and the axial end surface of the stationary scroll wrap 1*b*, and that of the distance between the wrap-side end surface of the orbiting end plate 2*a* and the mating surface of the front end plate 38 with the cup-like casing 37 must be carried out by moving the measuring instrument 50. Because the stroke (A1 or A2 in FIG. 11) of movement of the measuring instrument 50 is relatively large, the problem arose in that the measurement error tends to become large due to an undesired inclination of the element parts assembled or that of the measuring instrument 50.

SUMMARY OF THE INVENTION

The present invention has been developed to overcome the above-described disadvantages.

It is accordingly an objective of the present invention to provide an improved scroll compressor capable of minimizing a variation in axial gaps between axial end surfaces of the stationary and orbiting scroll wraps and associated orbiting and stationary end plates opposed thereto to enhance the performance and reliability of the compressor.

Another objective of the present invention is to provide the scroll compressor of the above-described type capable of stably circulating lubricant and refrigerant to reduce a noise during operation or a friction loss on a thrust bearing mounted therein.

In accomplishing the above and other objectives, the scroll compressor comprises a compressor housing, stationary and orbiting scroll members both accommodated in the compressor housing, a generally flat thrust bearing for supporting a thrust force axially applied to the orbiting scroll member, and a drive shaft rotatably accommodated in the compressor housing for orbiting the orbiting scroll member relative to the stationary scroll member. The stationary scroll member has a stationary end plate and a stationary scroll wrap protruding axially from the stationary end plate, while the orbiting scroll member has an orbiting end plate and an orbiting scroll wrap protruding axially from the orbiting end plate, with the orbiting scroll wrap being in engagement with the stationary scroll wrap to define a plurality of working pockets therebetween. The compressor housing is made up of a cup-like first casing having a suction port defined therein and a cap-like second casing having a discharge port defined therein, said first and second casings having respective mating surfaces secured to each other. At least one shim is interposed between the mating surfaces of the first and second casings. The stationary end plate is positioned in the proximity of the mating surfaces of the first and second casings so that a low-pressure chamber is defined between the stationary end plate and the first casing, while a high-pressure chamber is defined between the stationary end plate and the second casing.

In the above-described construction, because the stationary end plate is positioned in the proximity of the mating surfaces of the first and second casings, it is possible to reduce a variation in an axial gap between an axial end surface of the stationary scroll wrap and the orbiting end plate opposed thereto and an axial gap between an axial end surface of the orbiting scroll wrap and the stationary end plate opposed thereto.

The scroll compressor also comprises a rotation constraint member for permitting the orbiting scroll member to undergo an orbiting motion relative to the stationary scroll member while preventing rotation of the orbiting scroll member about its own axis, and a rotation restraint member secured to the first casing in the proximity of the rotation constraint member for permitting the rotation constraint member to move in only one direction perpendicular to the drive shaft. The rotation constraint member has a pair of first keys extending radially outwardly therefrom so as to be slidingly engaged in associated first key grooves defined in the orbiting end plate. The rotation constraint member also has a pair of second keys extending radially outwardly therefrom so as to be spaced 90° from the pair of first keys, with the pair of second keys being slidingly engaged in associated second key grooves defined in the rotation restraint member. One of the second key grooves communicates with a bottom portion inside the compressor housing through; a communication passage which creates a resistance to flow when a lubricant stored in the bottom portion flows therethrough. The rotation restraint member has a pair of communication channels defined therein along respective sides of each of the second key grooves so as to communicate the second key grooves with a space delimited by the orbiting scroll member, the rotation restraint member and the drive shaft for lubrication thereof.

Advantageously, a plurality of lubricant storage grooves having a depth of 1 to 10 μm are formed on that surface of the thrust bearing which is held in sliding contact with the orbiting end plate.

The employment of the above-described construction reduces noise during operation of the compressor and overcomes the problem of overloading radial bearings which problem has been hitherto caused by an increase in weight of the compressor. Furthermore, the above-described construction reduces the friction loss on sliding portions of the thrust bearing or the rotation constraint member and, also, reduces a variation in an axial gap between an axial end surface of the stationary scroll wrap and the orbiting end plate opposed thereto and an axial gap between an axial end surface of the orbiting scroll wrap and the stationary end plate opposed thereto, thereby enhancing the performance and reliability of the compressor.

In addition, the compressor of the above-described construction is not required to increase the kind of regulating shims and requires a lesser number of element parts compared with conventional compressors, thus ensuring the assembling accuracy and saving time and labor required for correcting assembling errors.

BRIEF DESCRIPTION OF THE DRAWINGS

The above and other objectives and features of the present invention will become more apparent from the following description of a preferred embodiment thereof with reference to the accompanying drawings, throughout which like parts are designated by like reference numerals, and wherein.

DETAILED DESCRIPTION OF THE PREFERRED EMBODIMENTS

Figure 1:
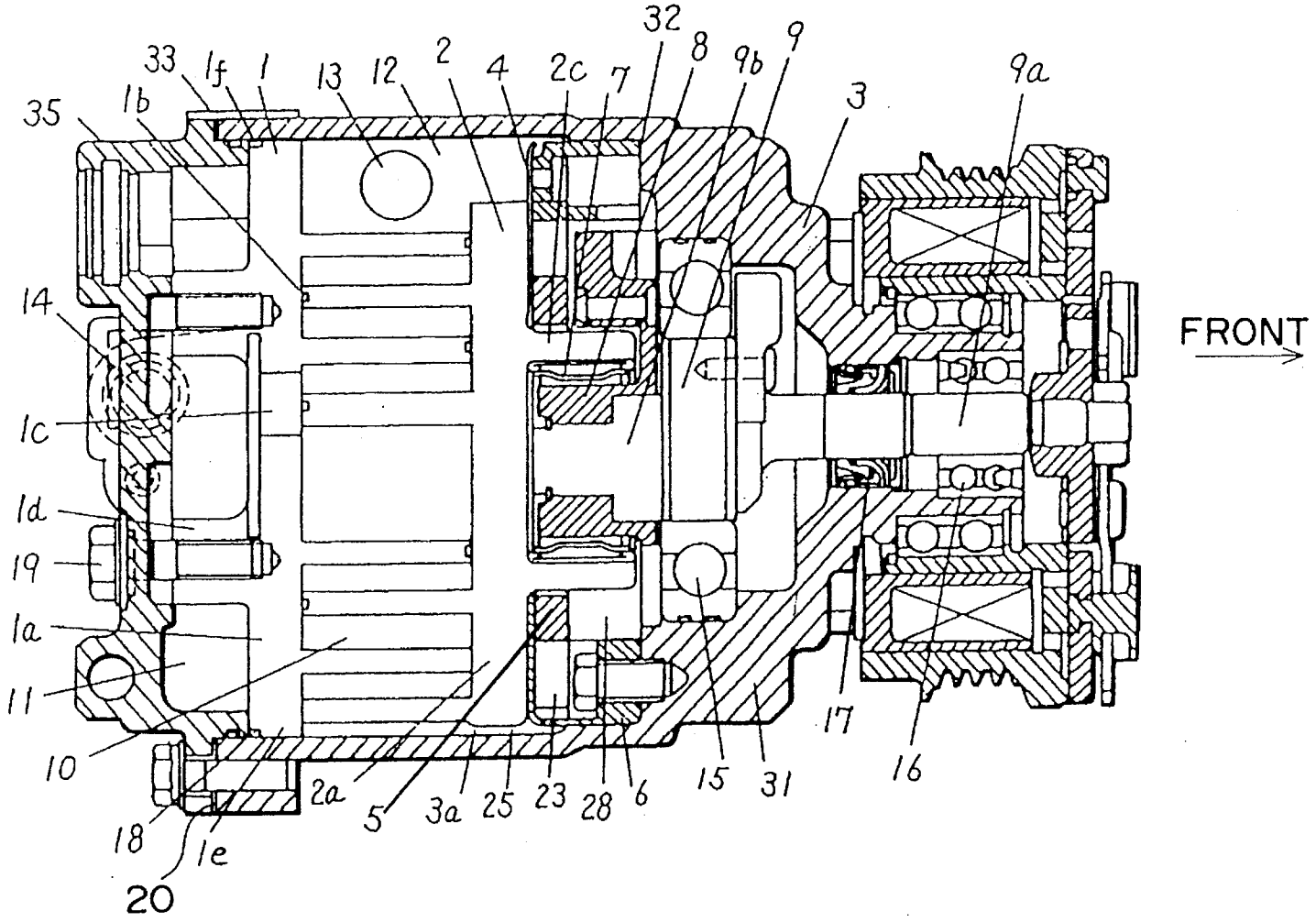
FIG. 1 is a longitudinal sectional view of a scroll compressor according to a preferred embodiment of the present invention.
Figure 2:
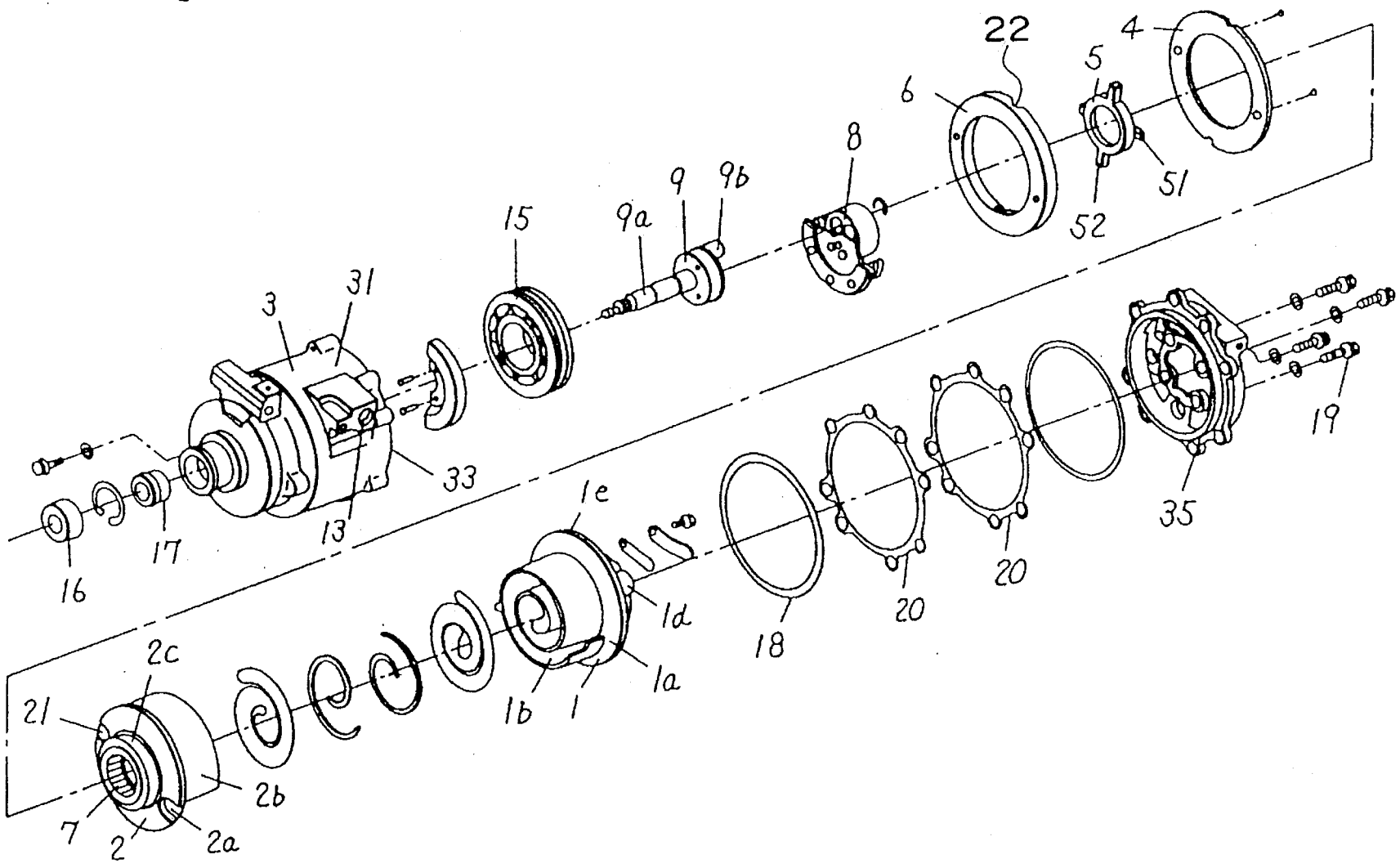
FIG. 2 is an exploded perspective view of the scroll compressor of FIG. 1.

FIGS. 1 to 4 depict a scroll compressor embodying the present invention. Referring particularly to FIGS. 1 and 2, a scroll compressor shown therein comprises a generally cylindrical compressor housing 3 including a cup-like front casing 31 and a cap-like rear casing 35 secured to each other. A stationary scroll member 1, including a stationary end plate 1*a* and a stationary scroll wrap 1*b* protruding axially from one end surface of the stationary end plate 1*a*, and an orbiting scroll member 2 similarly including an orbiting end plate 2*a* and an orbiting scroll wrap 2*b* protruding axially from one end surface of the orbiting end plate 2*a* are operatively accommodated within the compressor housing 3 with the stationary and orbiting scroll wraps 1*b* and 2*b* engaging with each other to define a plurality of volume-variable, sealed working pockets 10 therebetween. The orbiting end plate 2*a* is formed on a front surface with a cylindrical boss 2*c* extending concentrically and transversely therefrom in a direction away from the orbiting scroll wrap 2*b* and receiving therein an annular orbiting bearing 7 of an orbiting mechanism.

An orbiting motion of the orbiting scroll member 2 relative to the stationary scroll member 1 is carried out by a drive shaft 9 rotatably supported by the compressor housing 3 through a main bearing 15 securely mounted on the front casing 31. The drive shaft 9 extends through a sealing assembly 17 and an auxiliary bearing 16 and has a main shaft portion 9*a* protruding outwardly from the front casing 31. The drive shaft 9 has a rear end integrally formed with an eccentric drive pin 9*b* having its longitudinal axis parallel to, but offset a predetermined distance laterally from, the longitudinal axis of the drive shaft 9. The eccentric drive pin 9*b* is received in an eccentric bush 8, employed as one of a drive transmission mechanism, which is inserted into the orbiting bearing 7, so that a driving force from the drive shaft 9 may be transmitted to the orbiting bearing 7 to impart an orbiting motion to the orbiting scroll member 2. Between the orbiting end plate 2*a* and the front casing 31 are disposed a generally flat thrust bearing 4 extending in parallel to the orbiting end plate 2*a* for axially supporting a thrust force applied to the orbiting scroll member 2, an Oldham ring 5 employed as a rotation constraint member for permitting the orbiting scroll member 2 to undergo an orbiting motion relative to the stationary scroll member 1 while preventing rotation of the orbiting scroll member 2 about its own axis, and a rotation restraint member 6 positioned in the proximity of the Oldham ring 5 to permit it to move in only one direction perpendicular to the drive shaft 9.

The Oldham ring 5 has an annular rear surface formed with a pair of first keys 51 integrally formed therewith or otherwise rigidly secured thereto and extending radially outwardly therefrom. The first keys 51 are spaced 180° from each other and are slidingly engaged in associated key grooves 21 defined in a front surface of the orbiting end plate 2*a*. The Oldham ring 5 also has a pair of second keys 52 integrally formed therewith or otherwise rigidly secured thereto and extending radially outwardly therefrom. The pair of second keys 52 are located are substantially 90° spaced from the pair of first keys 51 and slidingly engaged in associated key grooves 22 defined in a rear surface of the rotation restraint member 6. The pair of first keys 51 and the respective key grooves 21 are employed as a first engaging means and a first retaining means for retaining the first engaging means therein, respectively, to permit the orbiting scroll member 2 to move along the thrust bearing 4 in only a first radial direction. The pair of second keys 52 and the respective key grooves 22 are employed as a second engaging means and a second retaining means for retaining the second engaging means therein, respectively, to permit the Oldham ring 5 to move along the thrust bearing 4 in only a second radial direction perpendicular to the first radial direction. The employment of the Oldham ring 5 reduces the number of element parts constituting the rotation constraint member, compared with the employment of the ball joint assembly shown in FIGS. 8 and 9.

Figure 3:
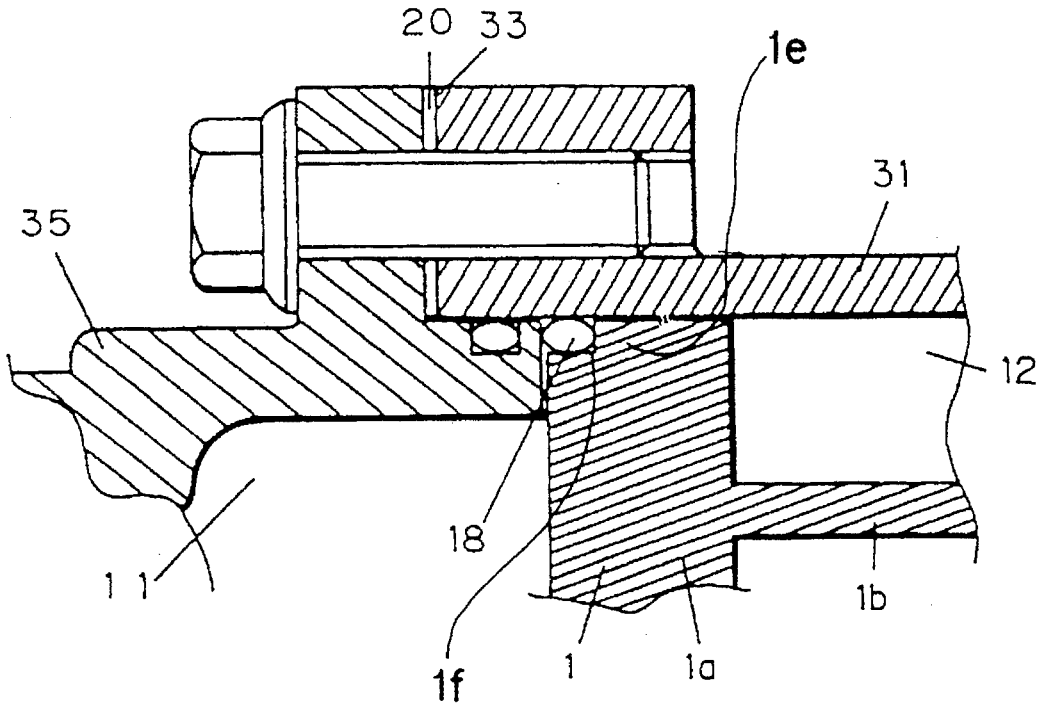
FIG. 3 is an enlarged fragmentary sectional view of mating portions of stationary and orbiting scroll members mounted in the scroll compressor of FIG. 1.

As best shown in FIG. 3, the stationary end plate 1*a* has a seal groove 1*f* defined therein along a peripheral portion 1*e* thereof, in which an O-ring 18 is received to seal between a high-pressure chamber 11 and a low-pressure chamber 12 both defined within the compressor housing 3 and partitioned by the stationary end plate 1*a*. The stationary scroll member 1 has a plurality of fastening legs 1*d* formed on a rear surface of the stationary end plate 1*a* with the fastening legs 1*d* fastened to the rear casing 35 having a discharge port 14 by means of bolts 19 to define the high-pressure chamber 11 between the stationary end plate 1*a* and the rear casing 35. The rotation restraint member 6 is secured to a rearwardly directed inner end surface 32 of the front casing 31 having a suction port 13, while the orbiting scroll member 2 to which the thrust force is applied is pressed against the rotation restraint member 6 via the thrust bearing 4. The from casing 31 is closed by the rear casing 35 with one or more shims 20 interposed between mating surfaces thereof in the proximity of the periphery of the stationary end plate 1*a* to regulate axial gaps between axial end surfaces of the stationary and orbiting scroll wraps 1*b* and 2*b* and associated orbiting and stationary end plates 2*a* and 1*a* opposed thereto. These gaps are hereinafter referred to simply as the axial gaps.

The orbiting motion of the orbiting scroll member 2 relative to the stationary scroll member 1 introduces refrigerant into the low-pressure chamber 12 through the suction port 13 of the front casing 31 and then to a location close to the peripheral portions of the stationary and orbiting scroll wraps 1*b* and 2*b*. The orbiting motion of the orbiting scroll member 2 further introduces the refrigerant into the sealed working pockets 10 defined between the stationary and orbiting scroll wraps 1*b* and 2*b* and causes the sealed working pockets 10 to move inwardly around the stationary and orbiting scroll wraps 1*b* and 2*b* towards a center discharge port 1*c* defined in the stationary end plate 1*a*, accompanied by progressive reduction in volume thereof. Therefore, the refrigerant drawing into each working pocket 10 experiences a decrease in volume and an increase in pressure as it approaches the center discharge port 1*c* and is subsequently discharged into the high-pressure chamber 11 through the center discharge port 1*c*.

Figure 4:
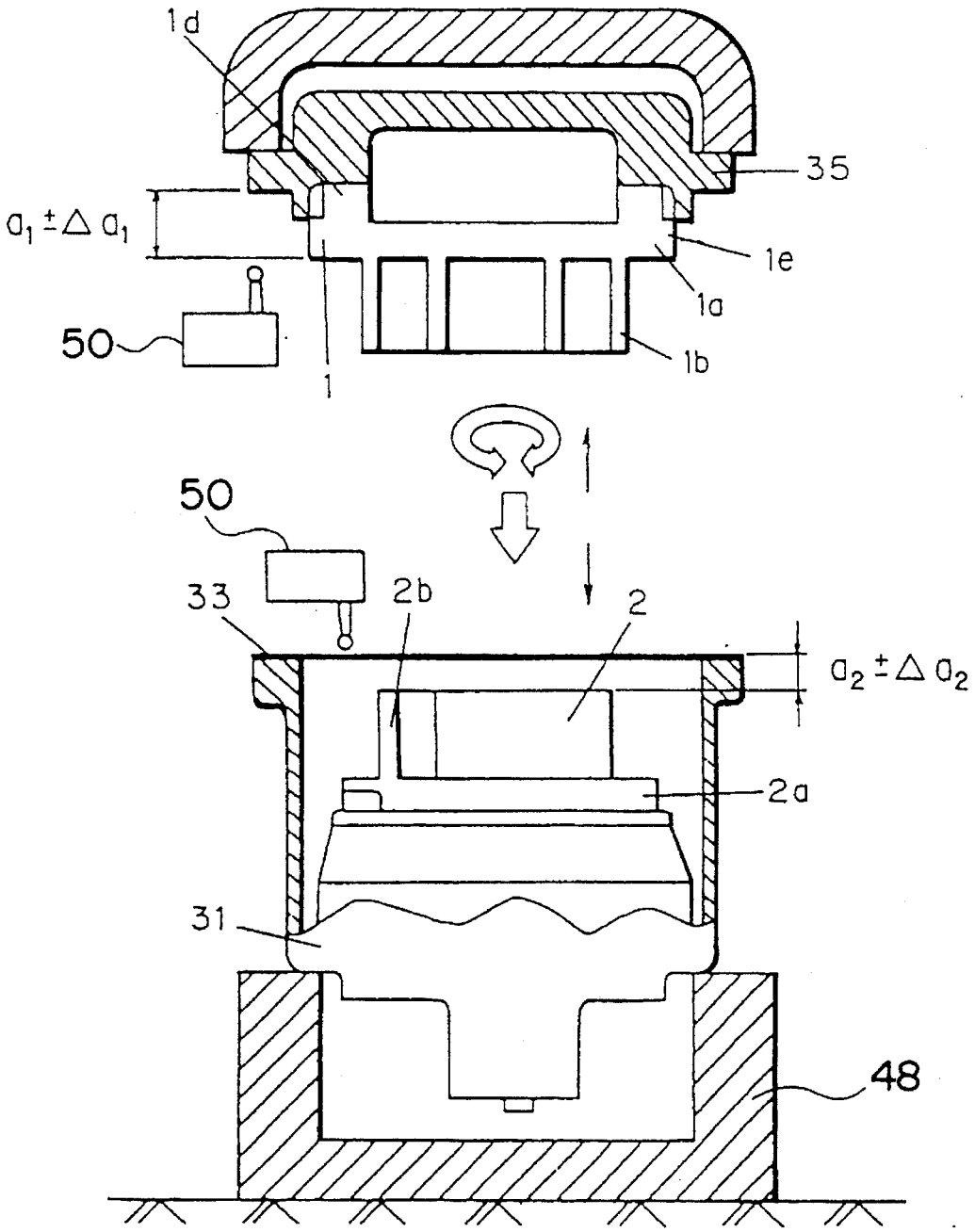
FIG. 4 is a schematic vertical view, partly in section, of the scroll compressor of FIG. 1 during assemblage.

FIG. 4 schematically depicts the scroll compressor during assemblage. As shown therein, the cup-like front casing 31 is first placed on a mount 48 with its open end directed upwardly and is subsequently coupled with the drive transmission mechanism and the orbiting mechanism. The orbiting scroll member 2 is then incorporated into the front casing 31 with the orbiting scroll wrap 2*b* directed upwardly. At this moment, the distance a2 between the upper end surface of the orbiting scroll wrap 2*b* and the mating surface of the front casing 31 with the cap-like rear casing 35 is measured using a measuring instrument 50. Likewise, the distance a1 between the lower end surface of the stationary end plate 1*a* and the mating surface of the rear casing 35 with the front casing 31 is measured using the measuring instrument 50. Then, the rear casing 35 is rigidly secured to the front casing 31 while the axial gaps are being regulated by changing the thickness of the shims 20 so that the difference between the two distances a1 and a2 may fall within a permissible tolerance.

Figure 11:
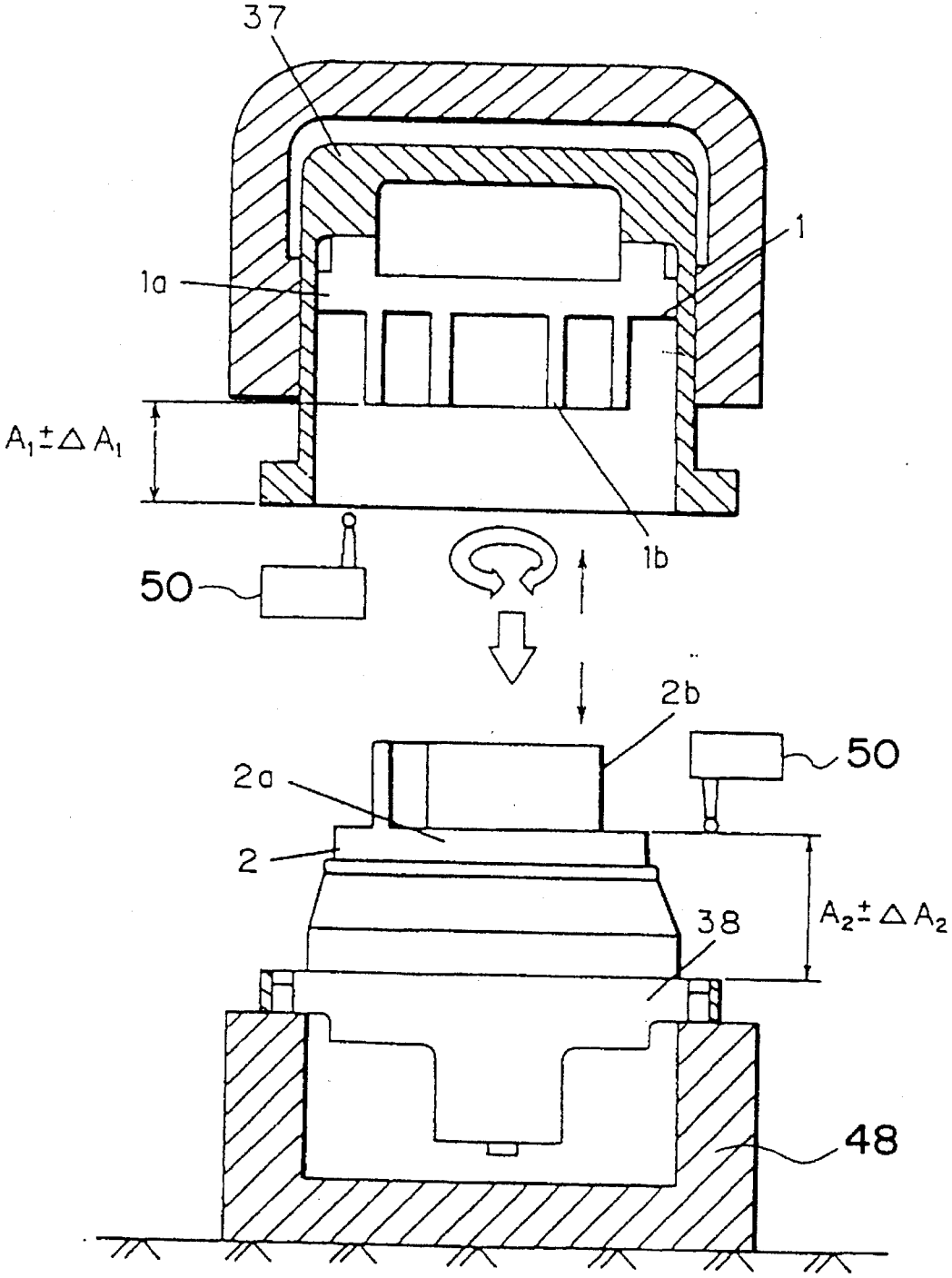
Fig. 11 PRIOR ART
FIG. 11 is a view similar to FIG. 4, but indicating a conventional scroll compressor during assemblage.

In measuring the distances a1 and a2 above, because the stationary end plate 1*a* is positioned in the proximity of the mating surfaces of the front and rear casings 31 and 35, the stroke of movement of the measuring instrument 50 is relatively small and, hence, measurement errors Δa1 and Δa2 can be made smaller than those ΔA1 and ΔA2 in the conventional scroll compressor shown in FIG. 11.

Accordingly, it is possible to reduce a variation in the axial gaps, ensuring the assembling accuracy of the compressor and facilitating the assemblage of the compressor. It is also possible to eliminate removal and reassemblage of the element parts already assembled which have been hitherto caused by adjustment or assembling errors.

Figure 5:
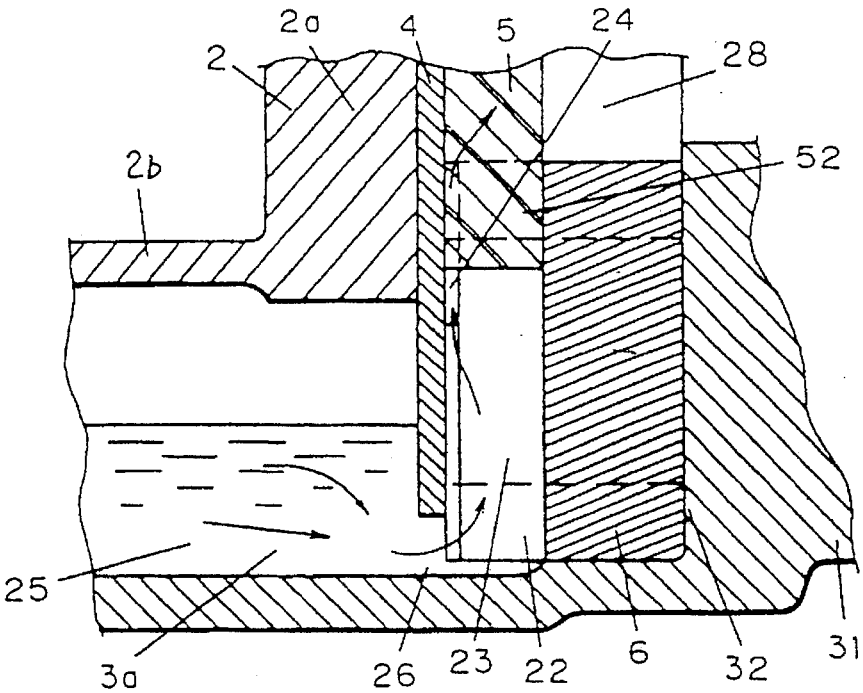
FIG. 5 is an enlarged vertical sectional view of a portion in the proximity of an Oldham ring mounted in the scroll compressor of FIG. 1, particularly indicating a lubricant flow.
Figure 6:
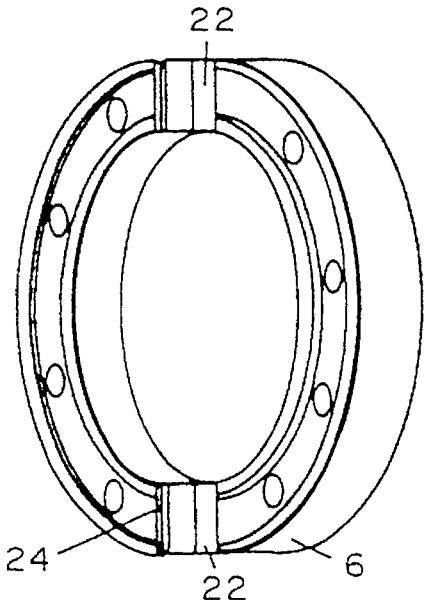
FIG. 6 is a perspective view of a rotation constraint element shown in FIG. 5.

FIG. 5 particularly depicts sliding portions of the thrust bearing 4 and the Oldham ring 5 during the operation of the compressor in which one of the key grooves 22 of the rotation restraint member 6 is positioned close to a bottom portion 3*a* inside the compressor housing 3. The space 23 defined in the lower key groove 22 and positioned radially outwardly of the lower second key 52 slidingly engaged therein is communicated with a lubricant storage portion 25 at the bottom of the compressor housing 3 through a relatively narrow communication passage 26 defined between the thrust bearing 4 and the compressor housing 3. As shown in FIG. 6, the rotation restraint member 6 has a pair of communication channels 24 defined therein along respective sides of each of the key grooves 22. The lower communication channels 24 communicate the space 23 referred to above with the space 28 delimited by the orbiting scroll member 2, rotation restraint member 6, drive shaft 9, and the like.

During operation of the compressor, because the oldham ring 5 is moved in the second radial direction i.e., in the vertical direction and because the relatively narrow communication passage 26 creates a resistance to flow, movement of the keys 52 in the second radial direction effects pumping to supply the sliding portions of the drive transmission mechanism, thrust bearing 4, Oldham ring 5 and the like encircling the space 28 with lubricant or refrigerant containing the lubricant in the lubricant storage portion 25 through the space 23. The lubricant or refrigerant so supplied is scattered radially outwardly by the action of the centrifugal force and again returns to the lubricant storage portion 25.

Figure 7A:
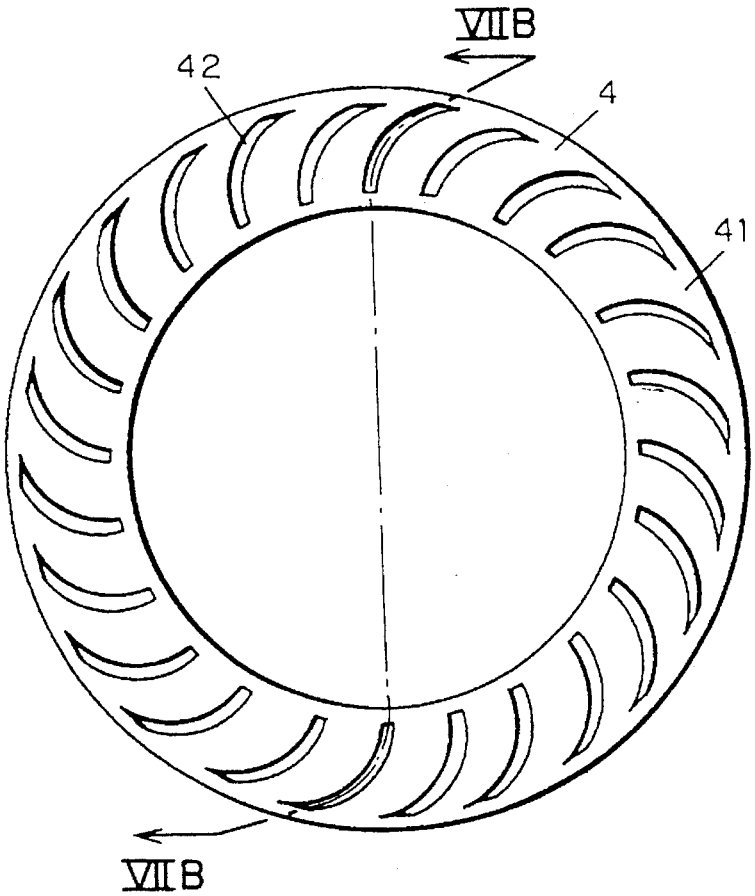
FIG. 7A is an elevational view of a thrust bearing mounted in the scroll compressor of FIG. 1.
Figure 7B:
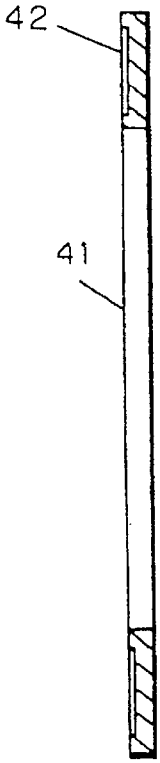
FIG. 7B is a sectional view taken along line VIIB—VIIB in FIG. 7A.

It is to be noted here that although opposite surfaces of the thrust bearing 4 may be of plane surfaces, a plurality of regularly spaced and radially curved lubricant storage grooves 42 may be formed on that surface 41 of the thrust bearing 4 which is held in sliding contact with the orbiting end plate 2*a*, as shown in FIGS. 7A and 7B. The depth of the lubricant storage grooves 42 preferably ranges from 1 to 10 μm. The provision of the lubricant storage grooves 42 greatly reduces the friction loss on the sliding portions of the thrust bearing 4, resulting in not only a reduction in loads applied to the main bearing 15 and the orbiting bearing 7, but also a reduction in noise.

Figure 8:
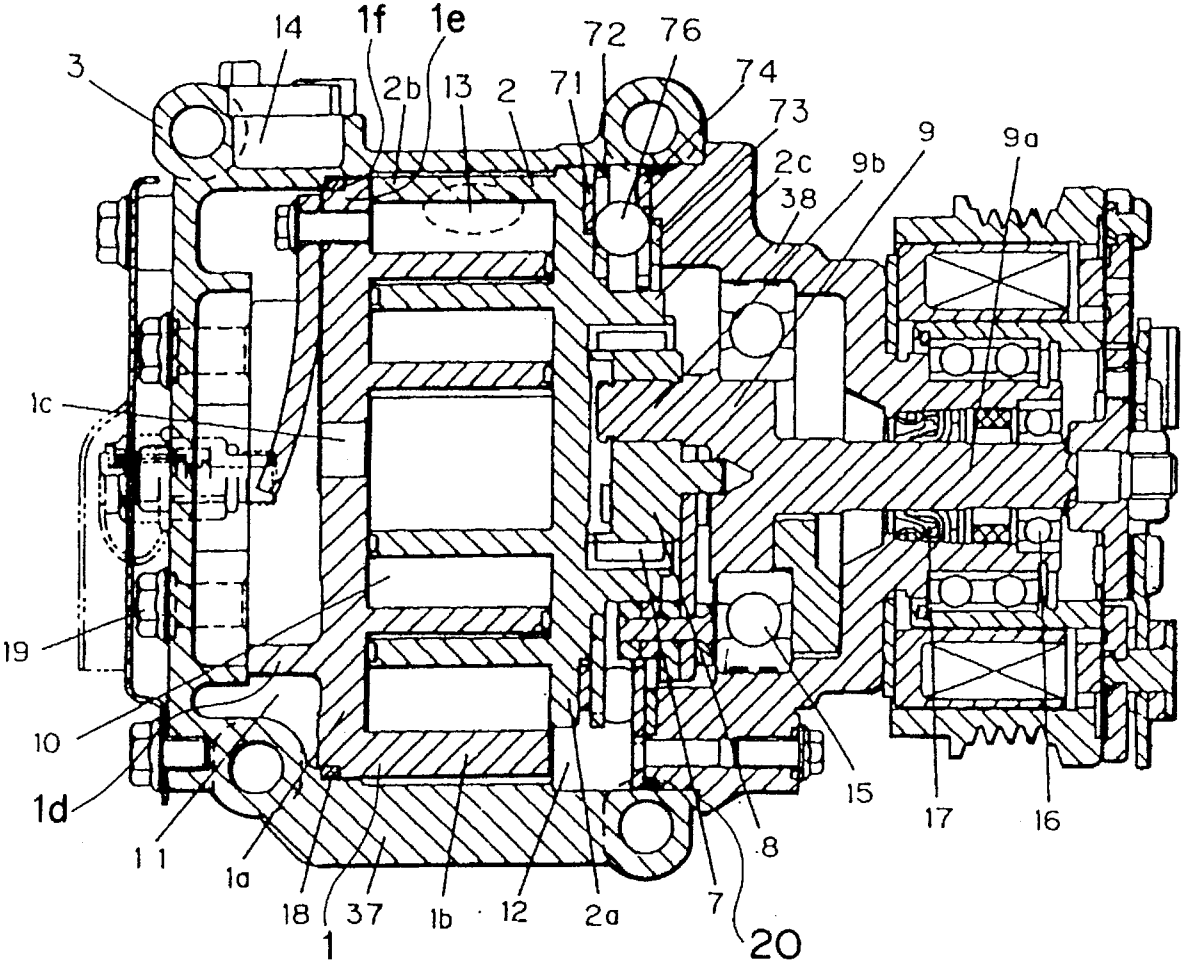
PRIOR ART Fig. 8
FIG. 8 is a longitudinal sectional view of a conventional scroll compressor employing a ball joint assembly.
Figure 9:
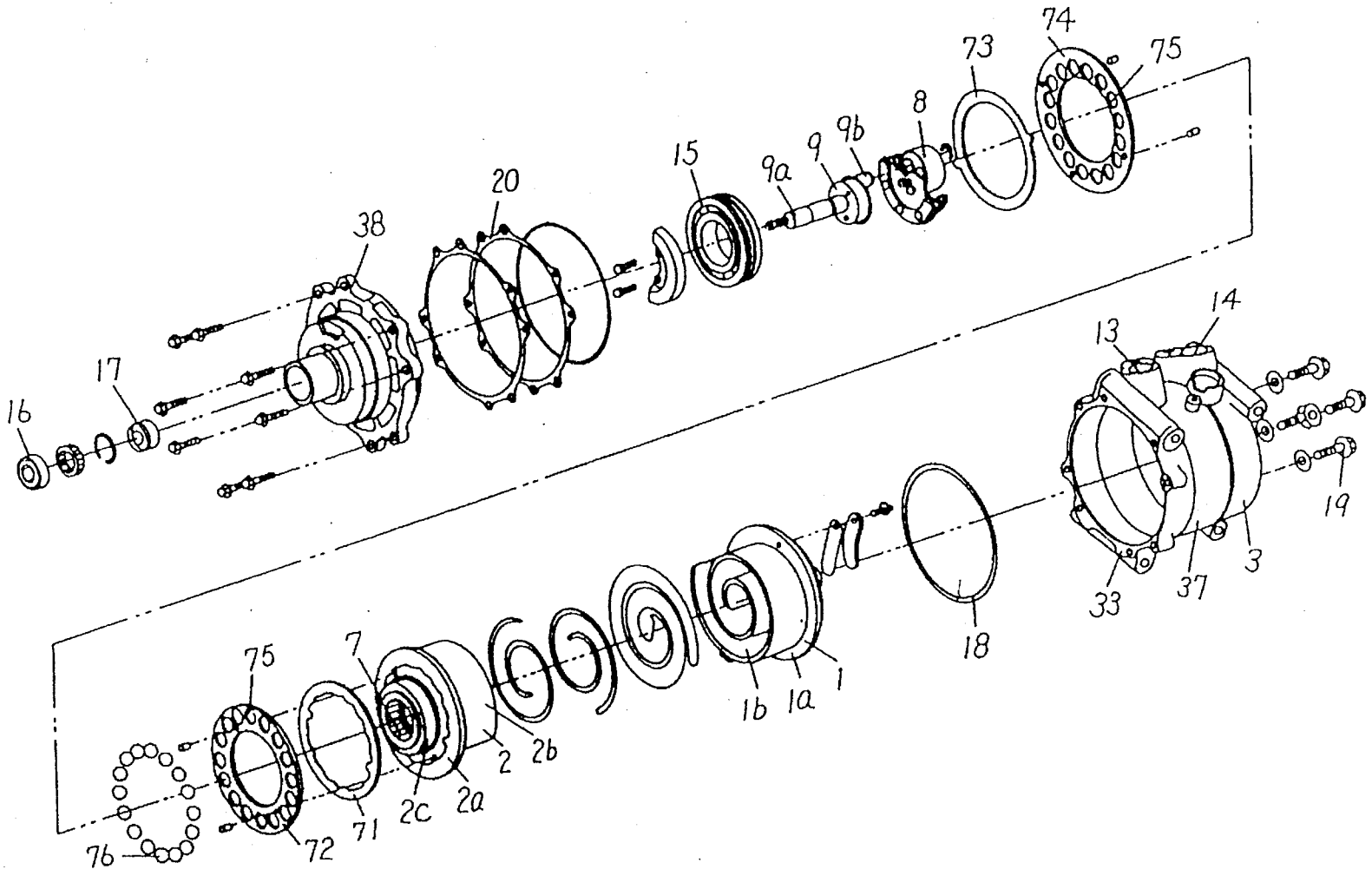
Fig. 9 PRIOR ART
FIG. 9 is an exploded perspective view of the conventional scroll compressor of FIG. 8.
Figure 10:
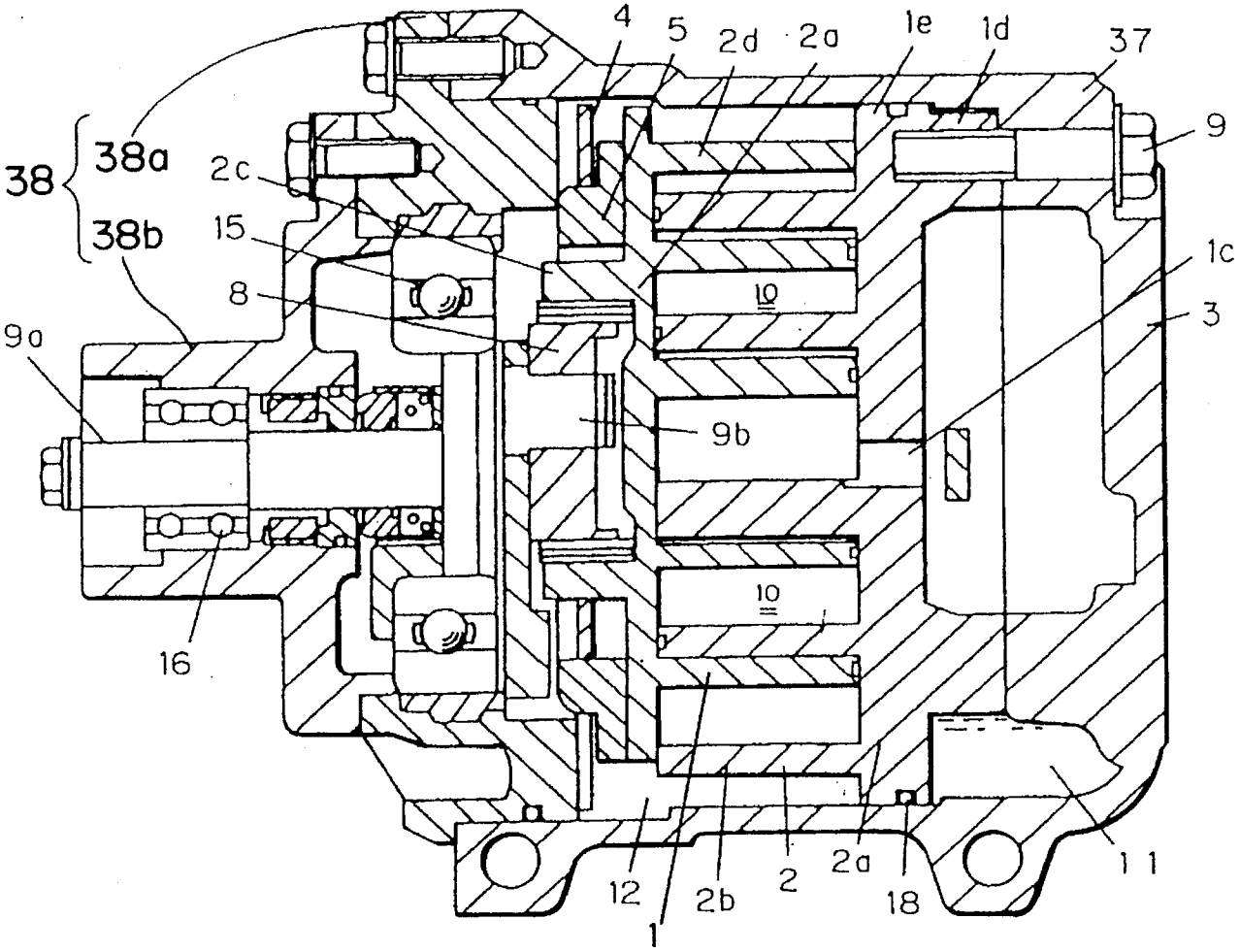
Fig. 10 PRIOR ART
FIG. 10 is a longitudinal section view of another conventional scroll compressor.

It is also to be noted that although in the conventional compressor shown in FIGS. 7 and 8 both of the suction port 13 and the discharge port 14 are formed in the cup-like casing 37, the scroll compressor of the present invention has a suction port 13 defined in the cup-like front casing 31 and a discharge port 14 defined in the cap-like rear casing 35. The formation of the suction port 13 and the discharge port 14 in the two separate casings 31 and 35 facilitates the manufacture of the compressor housing 3, resulting in a reduction in manufacturing cost.

As is clear from the above, according to the present invention, because the axial gaps, which are the key to the performance and reliability of the compressor, can be limited to small gaps, not only the performance is stably maintained, but the reliability is also enhanced. Furthermore, it is possible to eliminate time-consuming removal and reassemblage of the element parts already assembled which have been hitherto often caused by adjustment or assembling errors, thus enhancing the productivity and reducing the manufacturing cost.

A reduction in loads applied to the main bearing and the orbiting bearing extends the lifetime of the bearings. The employment of the Oldham ring reduces the number of element parts constituting the rotation constraint member, thus reducing the weight of the compressor and also reducing noise during operation.

Moreover, because the rotation restraint member is configured so as to circulate the lubricant, a desired stable operation of the compressor is ensured. The formation of the lubricant storage grooves on one surface of the thrust bearing reduces the friction loss, enhancing the performance of the compressor.

Although the present invention has been fully described by way of examples with reference to the accompanying drawings, it is to be noted here that various changes and modifications will be apparent to those skilled in the art. Therefore, unless such changes and modifications otherwise depart from the spirit and scope of the present invention, they should be construed as being included therein.

What is claimed is:

1. In a scroll compressor comprising a compressor housing, stationary and orbiting scroll members both accommodated in the compressor housing, a generally flat thrust bearing for supporting a thrust force axially applied to the orbiting scroll member, and a drive shaft rotatably accommodated in the compressor housing for orbiting the orbiting scroll member relative to the stationary scroll member, said stationary scroll member having a stationary end plate and a stationary scroll wrap protruding axially from the stationary end plate, said orbiting scroll member having an orbiting end plate and an orbiting scroll wrap protruding axially from the orbiting end plate, said orbiting scroll wrap being in engagement with the stationary scroll wrap to define a plurality of working pockets therebetween, wherein the improvement comprises:

said compressor housing being made up of a cup-like first casing having a suction port defined therein and a cap-like second casing having a discharge port defined therein, said first and second casings having respective mating surfaces secured to each other;

at least one shim interposed between said mating surfaces of said first and second casings;

a rotation constraint member for permitting said orbiting scroll member to undergo an orbiting motion relative to said stationary scroll member while preventing rotation of said orbiting scroll member about its own axis;

a rotation restraint member secured to said first casing in a proximity of said rotation constraint member for permitting said rotation constraint member to move in only one direction perpendicular to said drive shaft;

said rotation constraint member having a pair of first keys extending radially outwardly therefrom so as to be slidingly engaged in associated first key grooves defined in said orbiting end plate, said rotation constraint member also having a pair of second keys extending radially outwardly therefrom so as to be spaced 90° from said pair of first keys, said pair of second keys being slidingly engaged in associated second key grooves defined in said rotation restraint member, one of said second key grooves communicating with a bottom portion inside said compressor housing through a communication passage which creates a resistance to flow when a lubricant stored in said bottom portion flows therethrough, said rotation restraint member having a pair of communication channels defined therein along respective sides of each of said second key grooves so as to communicate said second key grooves with a space delimited by said orbiting scroll member, said rotation restraint member and said drive shaft for lubrication thereof; and said stationary end plate being positioned in a proximity of said mating surfaces of said first and second casings so that a low-pressure chamber is defined between said stationary end plate and said first casing, while a high-pressure chamber is defined between said stationary end plate and said second casing.

2. In a scroll compressor comprising a compressor housing, stationary and orbiting scroll members both accommodated in the compressor housing, a generally flat thrust bearing for supporting a thrust force axially applied to the orbiting scroll member, and a drive shaft rotatably accommodated in the compressor housing for orbiting the orbiting scroll member relative to the stationary scroll member, said stationary scroll member having a stationary end plate and a stationary scroll wrap protruding axially from the stationary end plate, said orbiting scroll member having an orbiting end plate and an orbiting scroll wrap protruding axially from the orbiting end plate, said orbiting scroll wrap being in engagement with the stationary scroll wrap to define a plurality of working pockets therebetween, wherein the improvement comprises:

said compressor housing being made up of a cup-like first casing having a suction port defined therein and a cap-like second casing having a discharge port defined therein, said first and second casings having respective mating surfaces secured to each other;

at least one shim interposed between said mating surfaces of said first and second casings;

said stationary end plate being positioned in a proximity of said mating surfaces of said first and second casings so that a low-pressure chamber is defined between said stationary end plate and said first casing, while a high-pressure chamber is defined between said stationary end plate and said second casing; and wherein a plurality of lubricant storage grooves having a depth of 1 to 10 μm are formed on that surface of said thrust bearing which is held in sliding contact with said orbiting end plate.

3. A scroll compressor comprising:

a generally cylindrical compressor housing made up of a cup-like first casing having a suction port defined therein and a cap-like second casing having a discharge port defined therein, said first and second casings having respective mating surfaces secured to each other;

at least one shim interposed between said mating surfaces of said first and second casings;

a stationary scroll member accommodated in said compressor housing and secured to said second casing, said stationary scroll member having a stationary end plate and a stationary scroll wrap protruding axially from said stationary end plate, said stationary end plate being positioned in a proximately of said mating surfaces of said first and second casings so that a low-pressure chamber is defined between said stationary end plate and said first casing, while a high-pressure chamber is defined between said stationary end plate and said second casing;

an orbiting scroll member accommodated in said compressor housing and having an orbiting end plate and an orbiting scroll wrap protruding axially from said orbiting end plate, said orbiting scroll wrap being in engagement with said stationary scroll wrap to define a plurality of working pockets therebetween;

an orbiting mechanism disposed on one side of said orbiting end plate;

a generally flat thrust bearing for supporting a thrust force axially applied to said orbiting scroll member;

a drive shaft rotatably mounted in said compressor housing and having a main shaft portion protruding outwardly from said compressor housing;

first and second bearings for rotatably supporting said drive shaft;

a drive transmission mechanism for transmitting a drive force of said drive shaft to said orbiting mechanism;

a rotation constraint member for permitting said orbiting scroll member to undergo an orbiting motion relative to said stationary scroll member while preventing rotation of said orbiting scroll member about its own axis; and a rotation restraint member secured to said first casing in a proximity of said rotation constraint member for permitting said rotation constraint member to move in only one direction perpendicular to said drive shaft, said rotation restraint member having a first surface substantially entirely held in contact with said thrust bearing and a second surface entirely held in contact with an inner surface of said first casing so that said thrust force acts to press said orbiting scroll member against said rotation restraint member via said thrust bearing.

4. The scroll compressor according to claim 3, wherein said rotation constraint member has a pair of first keys extending radially outwardly therefrom so as to be slidingly engaged in associated first key grooves defined in said orbiting end plate, said rotation constraint member also having a pair of second keys extending radially outwardly therefrom so as to be spaced 90° from said pair of first keys, said pair of second keys being slidingly engaged in associated second key grooves defined in said rotation restraint member, one of said second key grooves communicating with a bottom portion inside said compressor housing through a communication passage which creates a resistance to flow when a lubricant stored in said bottom portion flows therethrough, said rotation restraint member having a pair of communication channels defined therein along respective sides of each of said second key grooves so as to communicate said second key grooves with a space delimited by said orbiting scroll member, said rotation restraint member and said drive shaft for lubrication thereof.

5. The scroll compressor according to claim 3, wherein a plurality of lubricant storage grooves having a depth of 1 to 10 μm are formed on that surface of said thrust bearing which is held in sliding contact with said orbiting end plate.

* * * * *